US005150901A

United States Patent [19]

Stawicki

[11] Patent Number: 5,150,901

[45] Date of Patent: Sep. 29, 1992

[54] GOLF SWING TRAINING DEVICE

[76] Inventor: Raymond J. Stawicki, 1149 N. 92nd Street, #228, Scottsdale, Ariz. 85256

[21] Appl. No.: 826,474

[22] Filed: Jan. 27, 1992

[51] Int. Cl.[5] ..... A63B 69/36

[52] U.S. Cl. ..... 273/186.2; 273/191 R; 273/187.2

[58] Field of Search ..... 273/183 B, 186 A, 191 R, 273/191 A, 191 B, 192, 183 D

[56] References Cited

U.S. PATENT DOCUMENTS 4,509,757 4/1985 Yuhara ..... 273/186 A 4,519,608 5/1985 Gilly ..... 273/183 B 4,582,325 4/1986 Yuhara ..... 273/183 B X

*Primary Examiner*—George J. Marlo

*Attorney, Agent, or Firm*—Harry M. Weiss

[57] ABSTRACT

A golf swing training device including a harness assembly attachable to the upper portion of a person's body and an elongated tubular golf club swing guiding member having its opposite ends swively coupled to the harness assembly and to a golf club, respectively, to permit a golfer to achieve a proper golf swing by avoiding undesired bending of the front elbow of the golfer.

3 Claims, 2 Drawing Sheets

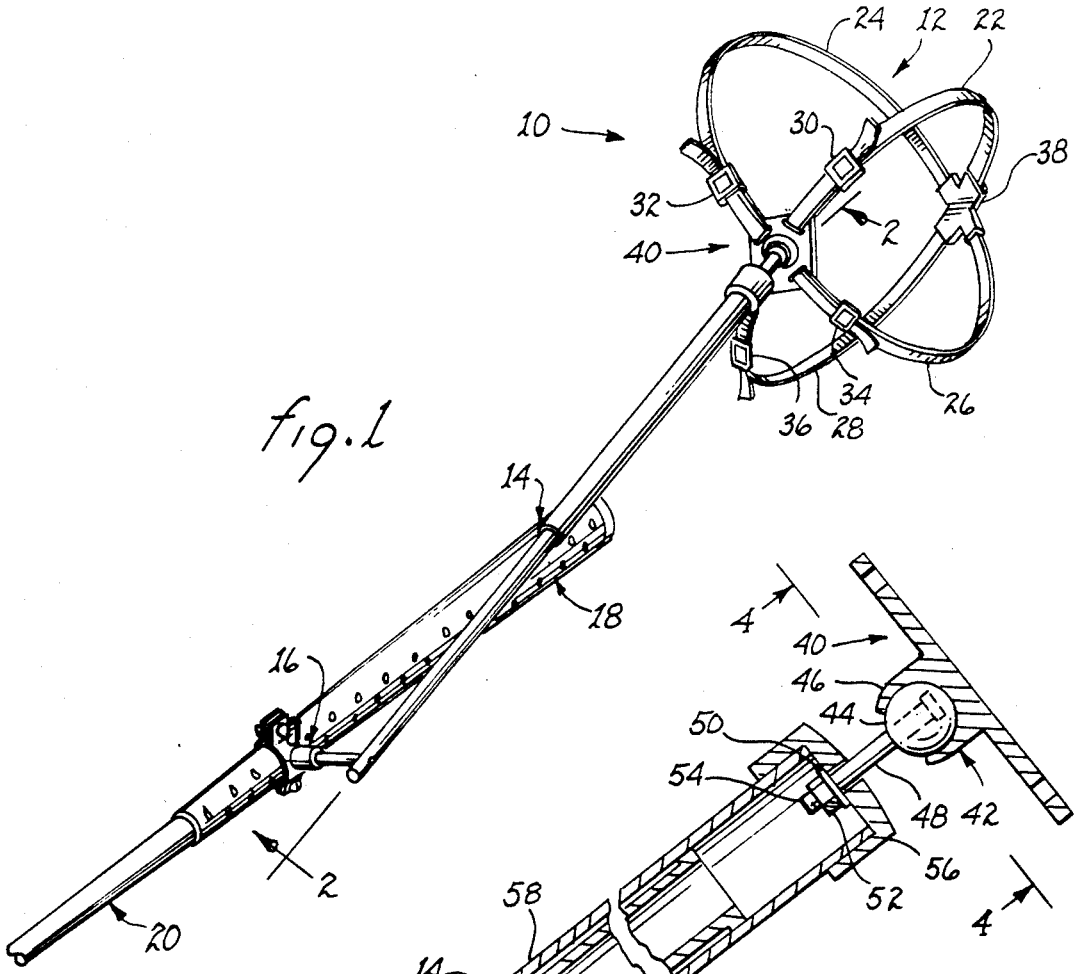
fig. 1
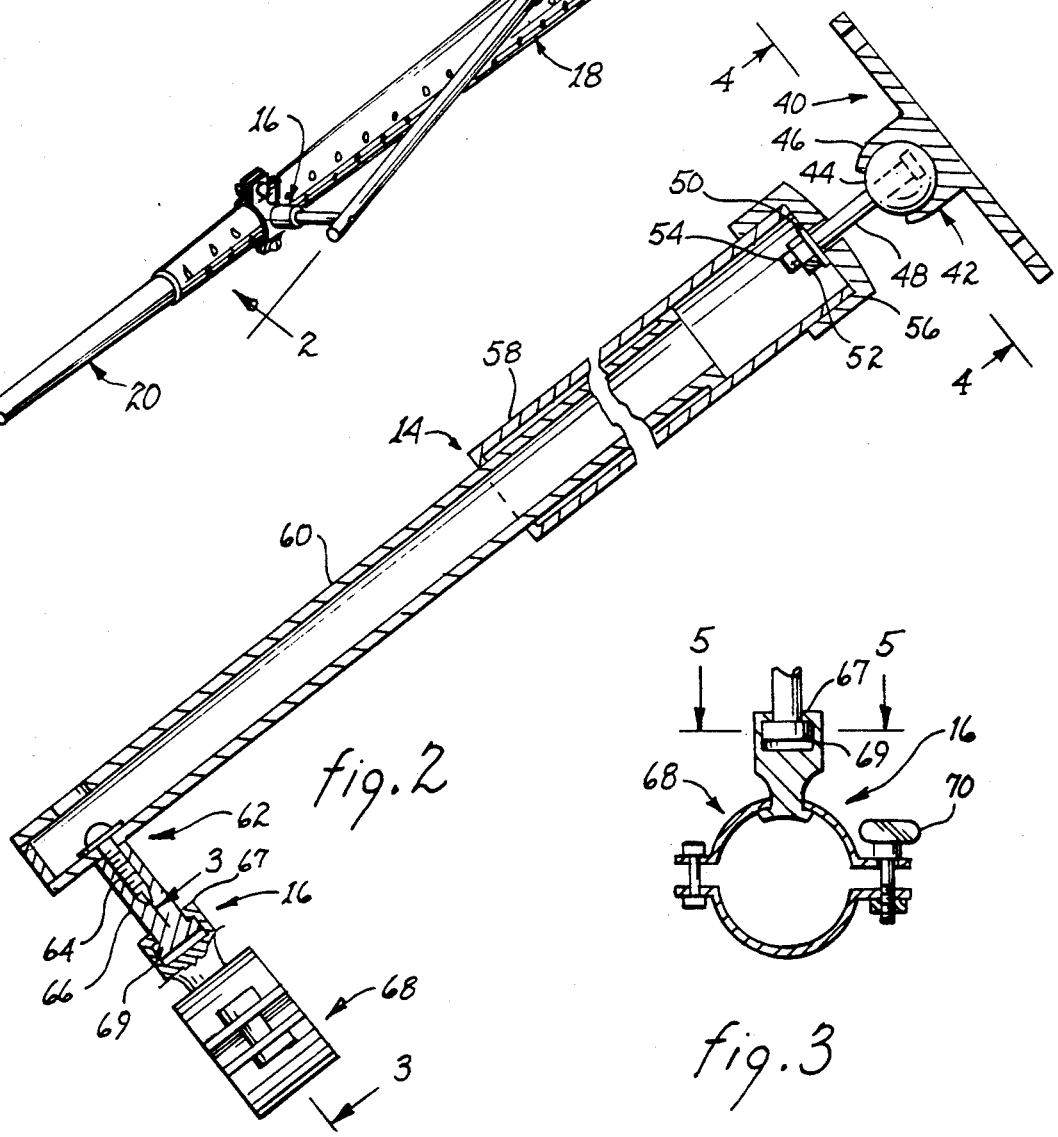
fig. 2
fig. 3

GOLF SWING TRAINING DEVICE

BACKGROUND OF THE INVENTION

1. Field of the Invention

The present invention relates generally to training devices and methods and, more specifically, to a training device and method for enabling a golfer to practice the correct swing for striking a golf ball for any particular (drive or iron) golf shot (other than for putting).

2. Description of the Related Art

Yuhara, U.S. Pat. Nos. 4,582,325 and 4,509,757, disclose a complex harness apparatus tied to an electronic system in order to provide a display of a person's golf swing. The golf club is gripped at the end thereof by the harness apparatus with the golfer gripping the club further down the handle of the club which does not permit the harness apparatus to properly guide and thereby train a golfer's swing.

Hourihan, U.S. Pat. No. 4,399,994 discloses a neck attachment golf swing training device that attaches to the bottom portion of a golf club or to the end of the golf club, however, this neck assembly arrangement is uncomfortable for the neck of the golfer and because of the location of either attachment to the golf club, does not provide the golfer with a true feel of the proper golf swing.

Grander U.S. Pat. No. 4,662,640 discloses a complex harness which uses two elastic straps configured as a V-shaped assembly which attaches to the end of the golf club, however, this flexible attachment arrangement does not permit a rigid, positive guide to train a golfer's swing.

Kubo U.S. Pat. No. 4,817,954 discloses a complicated golf swing training device that uses a head piece assembly containing a slot to hold the shaft of a golf club. This prior art device does not provide a golfer with a proper guide to train a golf swing.

Oppenheimer U.S. Pat. No. 3,595,583 discloses a complex and relatively costly apparatus for golf swing training which is too complicated for use by most golfers.

Therefore, a need existed to provide a fairly simple, easy to use, golf swing practice device that would create, with practice and repeated use of the device, a proper golf swing for any golfer.

SUMMARY OF THE INVENTION

Accordingly, it is an object of the present invention to provide an improved golf swing practice device and method which can be used to train golfers to correctly and properly swing a golf-club for every conceivable type of golf shot (except for putting)

It is another object of the present invention to provide an improved golf swing practice device and method which can be personally adjusted for each golfer and for every length and type of golf club excluding the putter.

It is still yet another object of the present invention to provide an improved golf swing practice device and method for use in practicing the proper type of back swing for chipping, pitching or driving a golf ball.

It is still yet another further object of the present invention to provide an improved golf swing practice device and method which can be used with equal ease by both right and left handed golfers by simply attaching and using the device in one of two possible orientations or configurations.

It is still even another further object of the present invention to provide an improved golf swing practice device and method that can be easily assembled for use and also easily removed by the golfer using the devices.

The foregoing and other objects, features and advantages will be apparent from the following description of the preferred embodiments of the invention as illustrated in the accompanying drawings.

BRIEF DESCRIPTION OF THE DRAWINGS

FIG. 1 is a perspective view of the golf swing practice device of the present invention shown connected near the bottom of the handle of a golf club;

FIG. 2 is a sectional view taken along the line 2—2 of FIG. 1 depicting of the ball socket connection and the telescopic tubular elements of the golf swing practice device of FIG. 1;

FIG. 3 is a sectional view taken long the line 3—3 of FIG. 2 depicting the clamping device used to grip the handle of the golf club;

DESCRIPTION OF THE PREFERRED EMBODIMENT

Figure 6:
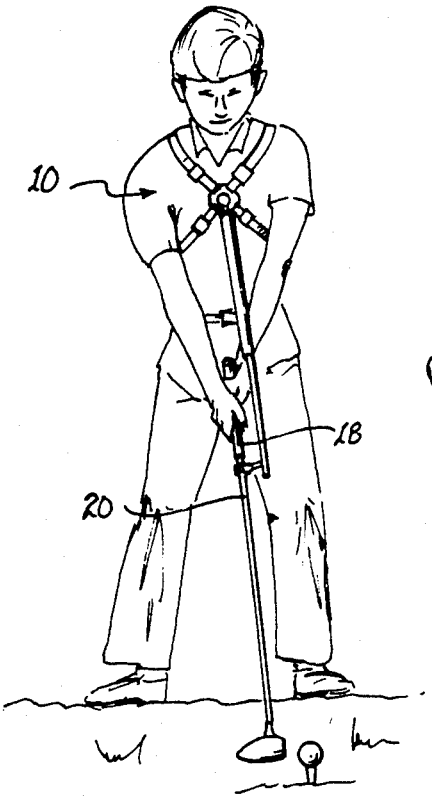
FIG. 6 is a front view of a golfer using the golf swing practice device of FIG. 1 in position for hitting a golf ball off of a golf tee.

FIG. 1 illustrates the golf swing practice device according to the present invention generally designed by reference number 10. The device 10 comprises a harness portion 12 which is coupled to preferably adjustable rod shaped elements 14 (see FIG. 2) that are coupled by swivel clamping mechanism 16 (see also FIGS. 2 and 3) to handle position 18 of a golf club 20. The harness portion 12 preferably comprises four adjustable straps 22, 24, 26 and 28 each of which have respective strap adjusting elements 30, 32, 34 and 36. A cruciform shaped back strap attaching member 38 serves to attach each of the straps 22, 24, 26 and 28 thereto on the back of a golfer when the device 10 is placed on a golfer's body. The harness portion 12 also comprises a front strap attaching member 40 which serves by means of four slits therein to couple the four straps 22, 24, 26 and 28 thereto and also functions to support ball-socket assembly 42 (see also FIG. 2).

Figure 4:
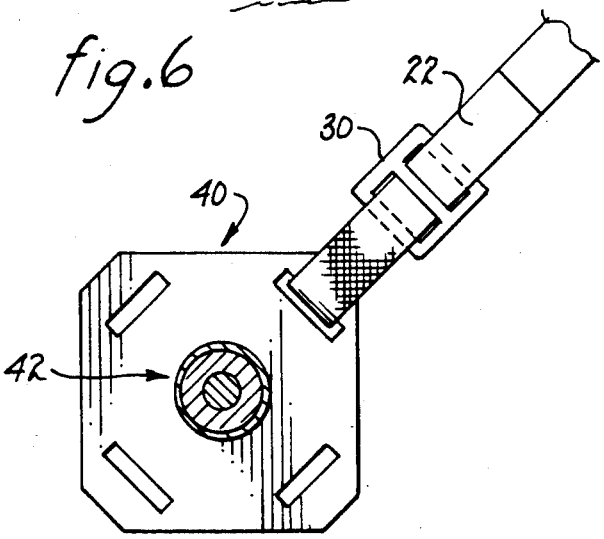
FIG. 4 is a view taken along the line 4—4 of FIG. 2 disclosing a front view of the ball-socket portion of the harness of the golf swing practice device of FIG. 1.
Figure 5:
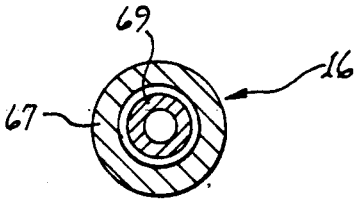
FIG. 5 is a sectional view taken along the line 5—5 of FIG. 3.

The ball-socket assembly 42 which is centrally located (see FIG. 4) comprises ball member 44 movably contained within socket member 46 (see FIG. 2). Shaft 48 which is secured to the ball member 44 (is shown in FIG. 2) is connected by washer 50 and nut 52 that attaches threaded end portion 54 to end cup shaped member 56 of elements 14. The elements 14 preferably comprise two rod shaped members 58 and 60 wherein rod shaped member 60 telescopes within rod shaped member 58. The rod shaped member 58 can be changed in length, as desired, according to the length of the arms of the golfer and also according to the length of use of the device 10. For example, gradual extension of a golfer's swing can be established using a slightly increased length rod shaped member 58 as compared to the initially used member 58. The use of increasingly longer tubes 58 adds more extension to a golfer's swing therefore creating more distance and giving the player's body more flexibility. The rod shaped member 58 is attached to the end cup shaped member 56 such as by the use of a slip fit between the inner surface portion of the end cup shaped member 56 and the outer surface portion of the outer end of the rod shaped member 58.

End portion 62 of the rod shaped member 60 is connected, as shown in FIG. 2 to the swivel clamping mechanism 16. Bolt 64 connects end portion 62 (by means of an aperture therein) to element 66 that contains an internally threaded recess portion to couple to the bolt 64. Swivel clamp 68 (see FIG. 3) permits, by a simple and easy to use finger screw device 70, attachment of clamp 68 to the handle 18 of the golf club 20 as shown in FIG. 1. As shown in FIGS. 2 and 3, swiveling action of the swivel clamp 68 is achieved by means of rotation of connection member 67 about coupling member 69 which is a very important aspect or feature of this invention because a golfer can properly cock their wrists during the back swing and subsequent down swing due to the swiveling action of the swivel clamp 68. The main purpose of the swivel clamp 16 is to achieve a proper hinge of the golfer's wrists on the back swing. The swivel clamping device 16 allows proper wrist hinging because it swivels on a plane that allows for accepted hand/wrist position throughout the swing. A major fault of most golfers is casting or throwing the golf club from the top of their swing, however, in the device of this invention, the golfer keeps the rod or tube 60 from separating from rod or tube 58 at the beginning of the downswing by exerting a slight downward pressure. This feature allows the player to create a proper downswing path delaying the wrist break and allowing for longer and straighter shots. The swivel clamping device 16 is important to the invention because it allows the wrists to hinge properly on the backswing and release on the downswing.

Figure 7:
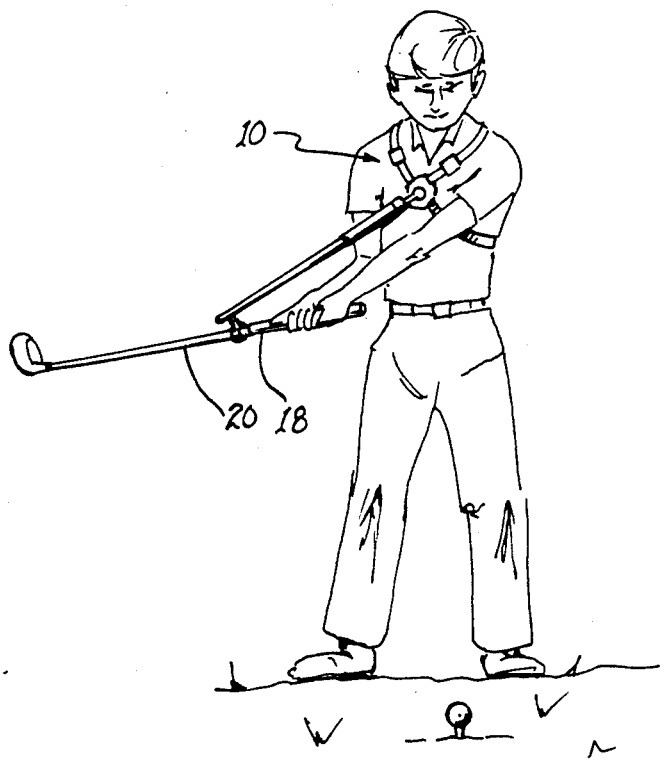
FIG. 7 is a front view of the golfer shown in FIG. 6 taking the golf club back in proper position using the golf swing practice device of FIG. 1.

Referring to FIGS. 6 and 7, the device 10 is shown in use by a golfer for striking a golf ball off of a tee using the golf club (which in this case is a driver) 20. In FIG. 6, the golfer is shown in position ready to bring his golf club 20 back in a proper swing to strike the golf ball off of the tee. In FIG. 7, the golfer is shown bringing his golf club 20 back for the golf shot and this view clearly depicts the significant advantages of the device 10 in enabling and, because of the arrangement of the various elements of the device 10, forcing the golfer to create a proper golf swing by bringing back the left arm (for a right handed golfer as shown in FIGS. 6 and 7) without bending the elbow (which if significantly bent is generally considered to be bad for a proper golf swing). FIG. 7 discloses that when the hands are about waist high, this is considered by all teachers of the game to be a significant checkpoint in the swing. At this point the toe of the club should be pointing straight up and the leading edge of the club perpendicular to the ground. The swivel clamp 16 allows a golfer to readily achieve this desired position Therefore, this device 10 requires a golfer to always practice striking a golf ball without significantly bending the front elbow thereby achieving a proper golf swing.

While the invention has been described in its preferred embodiments, it is to be understood that the words which have been used are words of description rather than limitation and that changes may be made within the purview of the appended claims without departing from the true scope and spirit of the invention in its broader aspects. As shown in the drawings, the device 10 is connected to the handle 18 of the golf club 20 spaced from the end of the handle 18 thereby permitting the golfer to position their hands on the handle 18, but yet permit the entire swing of the golf club 20 to be controlled to obtain a proper swing without undesired bending of the front elbow.

I claim:

1. A golf swing practice device for use in properly guiding the swing of a golfer swinging a golf cub comprising, in combination:

harness means for attaching to the upper portion of a person's body;

an elongated tubular golf club swing guiding member having upper and lower ends;

swivel means for swively coupling said upper and lower ends to said harness means and to a handle of a golf club, respectively, for permitting the golfer to achieve a proper swing of the golf club by swinging said golf club without significantly bending the front elbow of the golfer.

2. The golf swing practice device of claim 1 wherein ball-socket means connect said upper end of said tubular member to said harness means for permitting said tubular member to rotate relative to said harness means with the swing of the golfer.

3. The golf swing practice device of claim 1 wherein said tubular member comprises a pair of telescopic rod shaped members.

* * * * *